US006837487B1

(12) United States Patent
Oden et al.

(10) Patent No.: US 6,837,487 B1
(45) Date of Patent: Jan. 4, 2005

(54) WEED GUARD

(76) Inventors: George M. Oden, 1502 Montgomery Ave., Nashville, TN (US) 37207; Dottie L. Ross, 925 Oneida Ave., Nashville, TN (US) 37207

( * ) Notice: Subject to any disclaimer, the term of this patent is extended or adjusted under 35 U.S.C. 154(b) by 0 days.

(21) Appl. No.: 10/458,717

(22) Filed: Jun. 11, 2003

(51) Int. Cl.[7] ..... E04H 17/00

(52) U.S. Cl. ..... 256/1; 256/19; 256/24; 47/32; 52/102

(58) Field of Search ..... 256/1, 19, 20, 256/24; 47/32, 33; 52/102, 170

(56) References Cited

U.S. PATENT DOCUMENTS 3,822,864 A * 7/1974 Keys ..... 256/32
3,945,747 A * 3/1976 Cruz ..... 404/7
4,497,472 A * 2/1985 Johnson ..... 256/32
4,690,382 A * 9/1987 Koperdak ..... 256/1
5,039,065 A * 8/1991 Denton ..... 256/1
5,285,594 A * 2/1994 Penny ..... 47/9
5,328,156 A 7/1994 Hoke
5,421,118 A 6/1995 Bauer
5,452,541 A * 9/1995 DeMaio ..... 47/33
5,456,045 A 10/1995 Bradley et al.
5,535,545 A 7/1996 Matz
5,586,753 A * 12/1996 Michiaels ..... 256/32
5,961,101 A 10/1999 Anticole
2001/0013594 A1 8/2001 Thompson et al.

* cited by examiner

*Primary Examiner*—Daniel P. Stodola
*Assistant Examiner*—Michael P. Ferguson
(74) *Attorney, Agent, or Firm*—Richard C. Litman

(57) ABSTRACT

A weed guard that prevents weeds from growing along fences, buildings and other structures. The weed guard may be secured to the bottom of a fence, to vertically oriented structures, such as buildings or walls, or to horizontally oriented structures, such as sidewalks and driveways. The fence protecting weed guard has a plurality of linear guard links. The weed guard also has a plurality of post securing slots that secure adjacent linear guard links to one another while they are positioned around a fence post. The weed guard for building structures is a flexible, elongated body with a plurality of planar projection portions. One of the projection portions is mounted against the structure that is protected, one of the projection portions extends into the ground and one of the projection portions rests on top of the weeds.

10 Claims, 8 Drawing Sheets

WEED GUARD

BACKGROUND OF THE INVENTION

1. Field of the Invention

The present invention relates to weed growth prevention devices and more particularly to a weed guard that prevents the growth of weeds along the bottom of a building or fence.

2. Description of the Related Art

Weeds and overgrown grass are a common problem for most typical homeowners. Overgrown grass and weeds are aesthetically unpleasing to most homeowners and also, over a period of time, cause damage to a fence or side of a home. In the past weeds and overgrown grass were removed by hand by pulling out or chopping the weeds and grass. This is a very time consuming task. Weeds are also destroyed by spraying them with chemicals but this process is very expensive and the chemicals can be dangerous themselves. Another problem with removing weeds and overgrown grass is that they will just grow back. It would be less expensive and time consuming to prevent the weeds and overgrown grass from growing around the side of a home or a fence. Several weed growth prevention devices are commonly found in the market. Examples of such devices are found in the following patent documents.

U.S. Pat. Application No. 2001/0013594 to Thompson et al. discloses a fence guard that attaches to the bottom portion of a chain-linked fence in order to prevent grass and weeds from growing between the links. The fence guard has an L-shaped cover that allows it to be placed along the bottom edge of the fencing resting on the ground and against the fence. A mowing strip extends out horizontally from the fence and serves as a shield that will prevent plant growth along the fence line.

U.S. Pat. No. 5,328,156 issued to Hoke discloses a self-attaching fence trim guard. The fence trim guard self adheres to the bottom portion of a chain link or wooden fence without fasteners. The walls of the elongated body are tapered towards the center having a neck for accepting the fence and a curved bottom to provide a channel on each side to rapidly drain off water. The tapered walls of the trim guard grip the fence to hold the trim guard in place. The trim guard holds the bottom of the fence elevated above drainage channels to protect the fence from moisture or termite damage.

U.S. Pat. No. 5,421,118 to Bauer discloses a lawn edging system. The law edging system positions a row of edge blocks over underlying soil along a lawn or planter edge. The edging system includes an elongated restraining channel having opposed sidewalls extending continuously along its length. The sidewalls are transversely spaced from each other to receive and hold a row of edge blocks alongside a lawn edge. The elongated channel has a floor formed from spaced floor leaves extending across the elongated channel. The sidewalls are severed and bent between the spaced floor leaves. This allows the channel to conform to a curved lawn edge.

U.S. Pat. No. 5,456,045 to Bradley et al. discloses a lawn edging strip in the form of a strip having a top edge configured for withstanding hammering, a bottom end edge that is configured for penetration into the ground and ends that are constructed for interlocking with adjacent strips. A plurality of spaced apart ribs extend from both sides of the strip and provide rigidity to the strip. The ribs taper towards the bottom edge of the strip to facilitate the penetration of the strip into the ground.

U.S. Pat. No. 5,535,545 issued to Matz discloses a lawn and garden edging system. The lawn and garden edging system provides a border device for lawns with provisions for attaching watering or lighting mechanisms. An insertion structure is inserted into the ground by use of a handle that is placed into an aperture allowing an individual to stand on an upper end of the structure allowing the installer's weight to force the structure into the ground. The upper portion of the structure forms a passageway with apertures available for positioning watering or lighting components.

U.S. Pat. No. 5,961,101 issued to Anticole discloses a modular edging and modular interconnecting fence. The interlocking edging comprises a plurality of sheet panels. An offset and double fold are located along a first edge of each panel. The double fold defines a gap that is aligned with the panel. Along the outer edge, there is an offset and double fold that defines a gap offset from the panel where the edges of two adjacent panels may be slid together to form a lock seam joint. A molded plastic fence is designed to attach to the installed edging.

None of the above inventions and patents, taken either singularly or in combination, is seen to describe the instant invention as claimed. Thus a fence guard solving the aforementioned problems is desired.

SUMMARY OF THE INVENTION

The present invention is a weed guard that prevents weeds from growing along and damaging fences, buildings and other structures. A first embodiment of the weed guard may be secured to the bottom of a fence. An additional embodiment of the weed guard may be secured to vertically oriented structures, such as buildings or walls. An alternate embodiment of the building weed guard may be secured to horizontally oriented structures, such as sidewalks and driveways. The weed guards are removable so that they may be repositioned or transferred from one structure to another. The weed guards are made from a flexible rubber or soft plastic, which allows the weed guards to conform to any structure.

The fence protecting weed guard embodiment comprises a plurality of linear guard links. Each of the linear guard links has a pair of ends, a bottom surface and upwardly convergent side portions that form a peaked top portion. The linear guard links are elongate members with a triangular cross section. The linear guard members are positioned along the entire length of a fence underneath the bottom surface of the fence. The bottom surface of the base portion extends several inches out from both sides of the fence. The upwardly convergent side portions are inclined so the linear guard becomes increasingly narrower as it approaches the peaked top region. The peaked top region is positioned in the center of the linear guard member and fits in direct contact with the bottom of the fence.

The weed guard further comprises a plurality of post securing slots that are disposed on each of the ends of each linear guard link. The post receiving slots are adapted to secure adjacent linear guard links to one another while they are positioned around a fence post. The shape and dimensions of the post receiving slots are equal to one half of the circumference of the fence posts so that each of the post receiving slots fits around exactly one half of the fence post. The post receiving slots on adjacent fence posts each fit around the fence post and then engage one another to secure the weed guard to the fence. A rubber adhesive is applied to the ends of each linear guard link to further secure the adjacent linear guard links to one another. The post receiving slots may be adapted to fit around circular or square fence posts. The weed guards also include a plurality of corner guard links that each have at least one end adapted to secure the weed guard around corner fence posts. The securing end of the corner guard links is angled to fit around the corner fence posts.

The weed guard for building structures comprises a flexible, elongated body that may be secured to horizontally or vertically disposed structures. The weed guard comprises a plurality of planar projection portions. The weed guard further comprises, at least, a base projection portion, a ground mounting projection portion and a back projection portion. The back projection portion is mounted against the structure to be protected. The base projection portion is positioned on top of the grass and weeds to prevent them from contacting the building structure. The ground mounting projection portion is inserted into the ground to maintain the weed guard in a desired position. A rubber adhesive may be applied to the back projection portion to secure the weed guard against the building structure.

Accordingly, it is a principal object of the invention to provide a weed guard that can protect a fence or building structure from damage caused by weeds.

It is another object of the invention to provide a weed guard that maintains a clean fence or building line and minimizes the amount of maintenance for the owner.

It is a further object of the invention to provide a weed guard that may securely fit to fences as well as vertically and horizontally disposed building structures.

Still another object of the invention is to provide a weed guard that may be easily removed and relocated.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
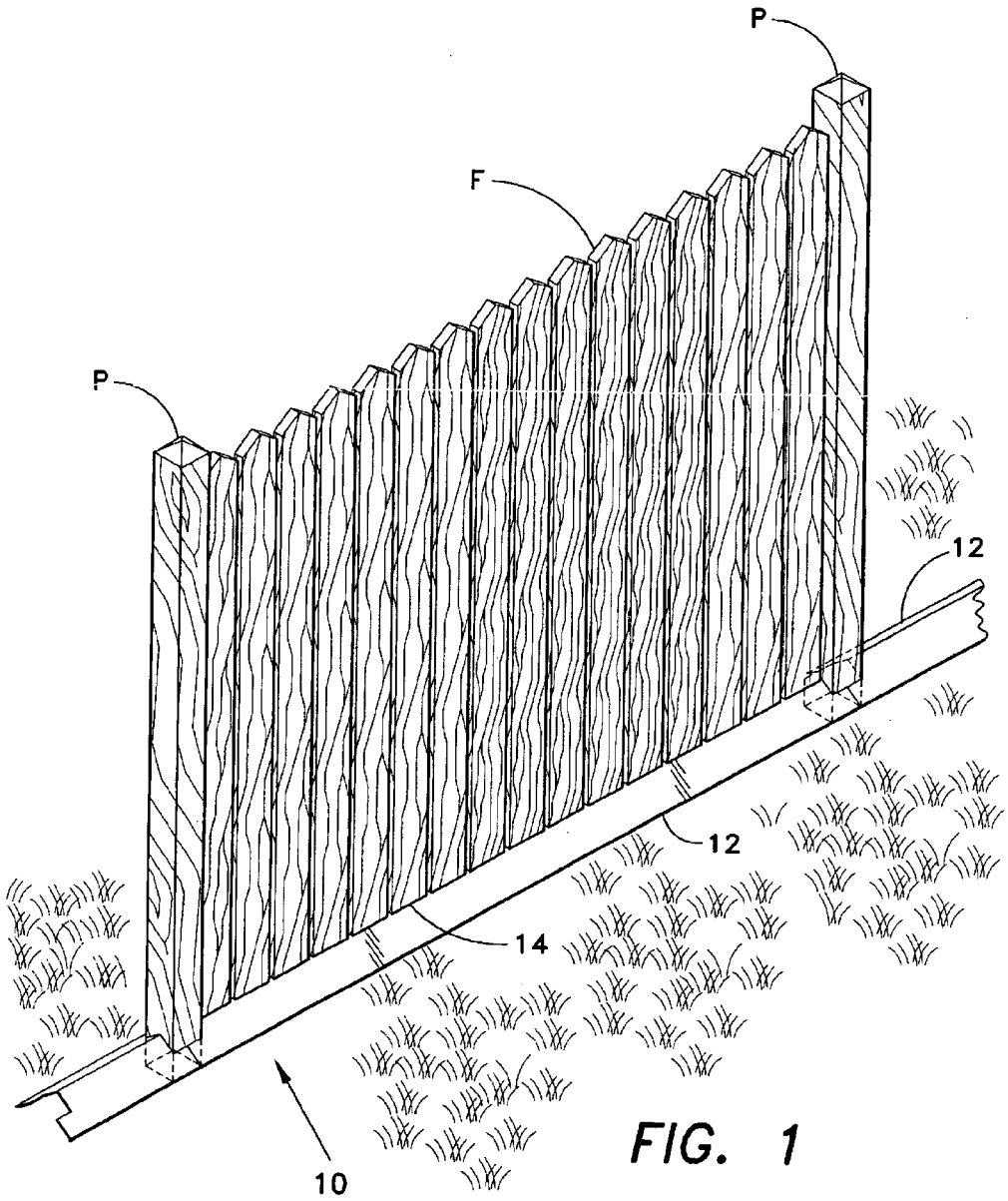
FIG. 1 is an environmental, perspective view of a weed guard according to the present invention.

The present invention is a weed guard that prevents weeds from growing along and damaging fences, buildings and other structures. FIG. 1 depicts an environmental perspective view of a weed guard 10 according to the present invention. The weed guard 10 is positioned underneath the bottom edge of a fence F. The weed guard 10 is secured to the bottom portion of the fence posts P. The weed guard 10 comprises a plurality of linear guard links 20 (shown in FIG. 2) that form an elongated semi-rigid member. The weed guard 10 further comprises a bottom surface 12 and a peaked top portion 14. The bottom surface 12 of the weed guard extends several inches out from both sides of the fence F and is positioned on top of the weeds and grass growing along the fence F. The peaked top portion 14 contacts the bottom of the fence F to create a secure fit underneath the fence F.

Figure 2:
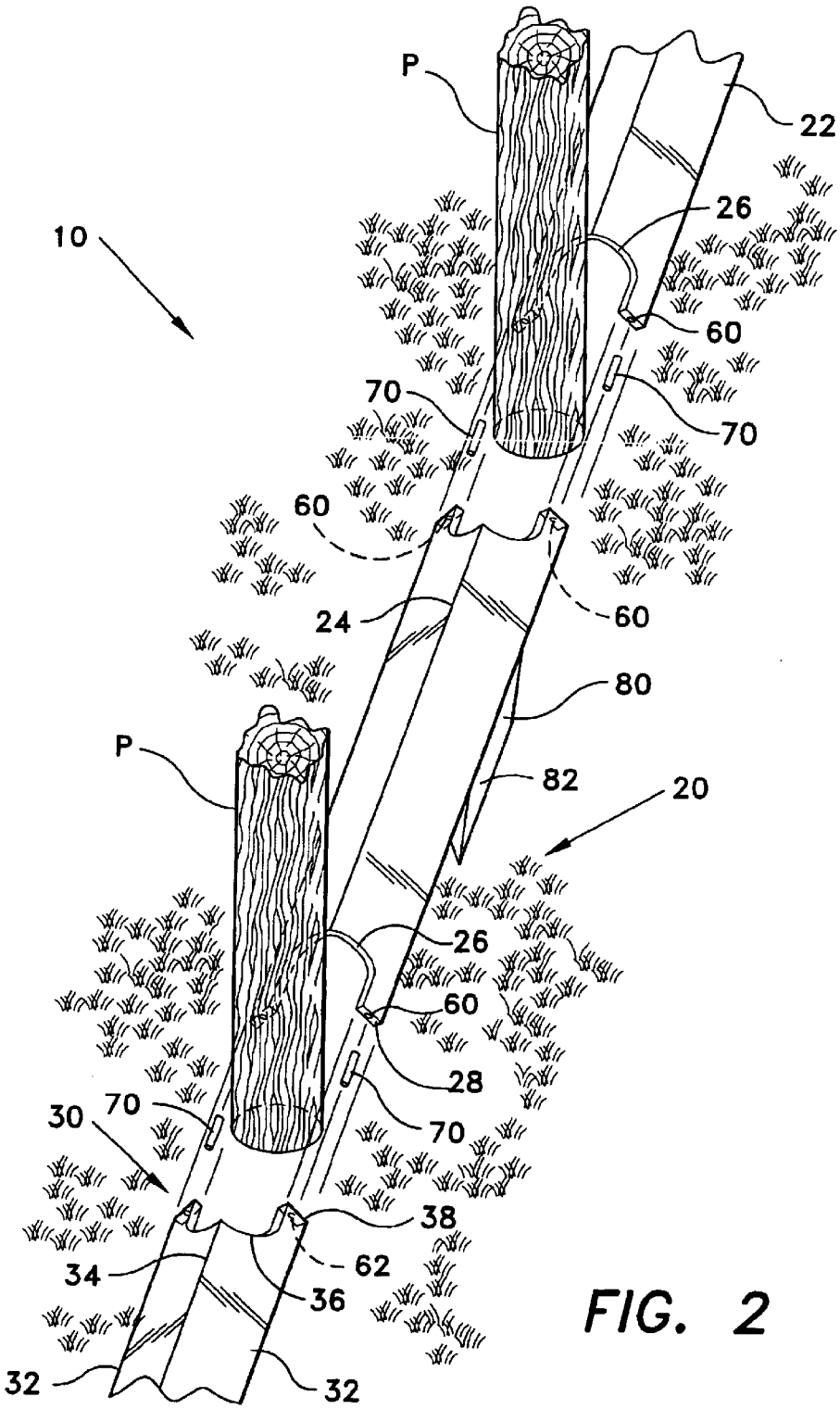
FIG. 2 is an exploded top perspective view of a first embodiment of the weed guard.

FIG. 2 depicts an exploded top perspective view of a weed guard according to a first embodiment of the present invention. The weed guard 20 in the present embodiment is adapted to fit to a fence F with circular posts P. The weed guard 10 comprises a plurality of linear guard links 20. Each of the linear guard links 20 further comprises two ends 28, two upwardly convergent side portions 22 and a peaked top portion 24. The upwardly convergent side portions 22 intersect to form the peaked top portion 24, which fits in contact with the bottom of the fence F. Each end 28 of the linear guard links 20 further comprises a post receiving slot 26. The post receiving slot 26 allows the linear guard links 20 to be secured to the fence posts P.

Each linear guard link 20 is secured to an adjacent linear guard link 30. The adjacent linear guard link 30 also comprises two ends 38, two upwardly convergent side portions 32, a peaked top portion 34 and post receiving slots 36 disposed on each of the two ends 38. Each of the post receiving slots 26, 36 have a shape and dimensions that are equal to one half of the circumference of the fence post P. Therefore, each of the post receiving slots 26, 36 securely fit around one half of the fence posts P. The linear guard link 20 and the adjacent linear guard link 30 fit around a fence post P and the ends 28, 38 of the linear guard link 20 and the adjacent linear guard link 30 engage one another to form the elongated weed guard 10.

The guard links 20,30 further comprise a plurality of connector holes 60,62. The connector holes 60,62 are disposed on the ends 28,38 of the guard links 20,30. The connector holes 60, 62 are adapted to receive a plurality of fasteners 70. The fasteners 70 are preferably dowels that securely fit into the connector holes 60, 62 to connect adjacent the adjacent guard links 20,30. The fasteners 70 are not limited to being dowels and any suitable fastener may be used to connect the adjacent guard links 20, 30. An adhesive may be applied to each of the ends 28, 38 to more securely connect the guard links 20, 30 to one another around the fence post P. The adhesive is preferably a rubber adhesive but any suitable adhesive material may be used.

Certain embodiments of the weed guard 10 optionally comprise a ground fastener 80 for securing the weed guard 10 in the ground underneath the fence F. The ground fastener 80 is disposed along the bottom surface 12 of the weed guard 10 and is positioned approximately one foot from each fence post P. The ground fastener 80 is an elongate member with a generally triangular cross section having a bottom pointed region 82. The ground fastener 80 is used when the weed guard 10 is put into place prior to the fence F being put into position. In instances where the fence F is already in existence it is easier to position the weed guard 10 underneath the fence F without having the ground fastener 80. Therefore, the weed guard 10 can be made with or without the ground fastener 80.

Figure 3:
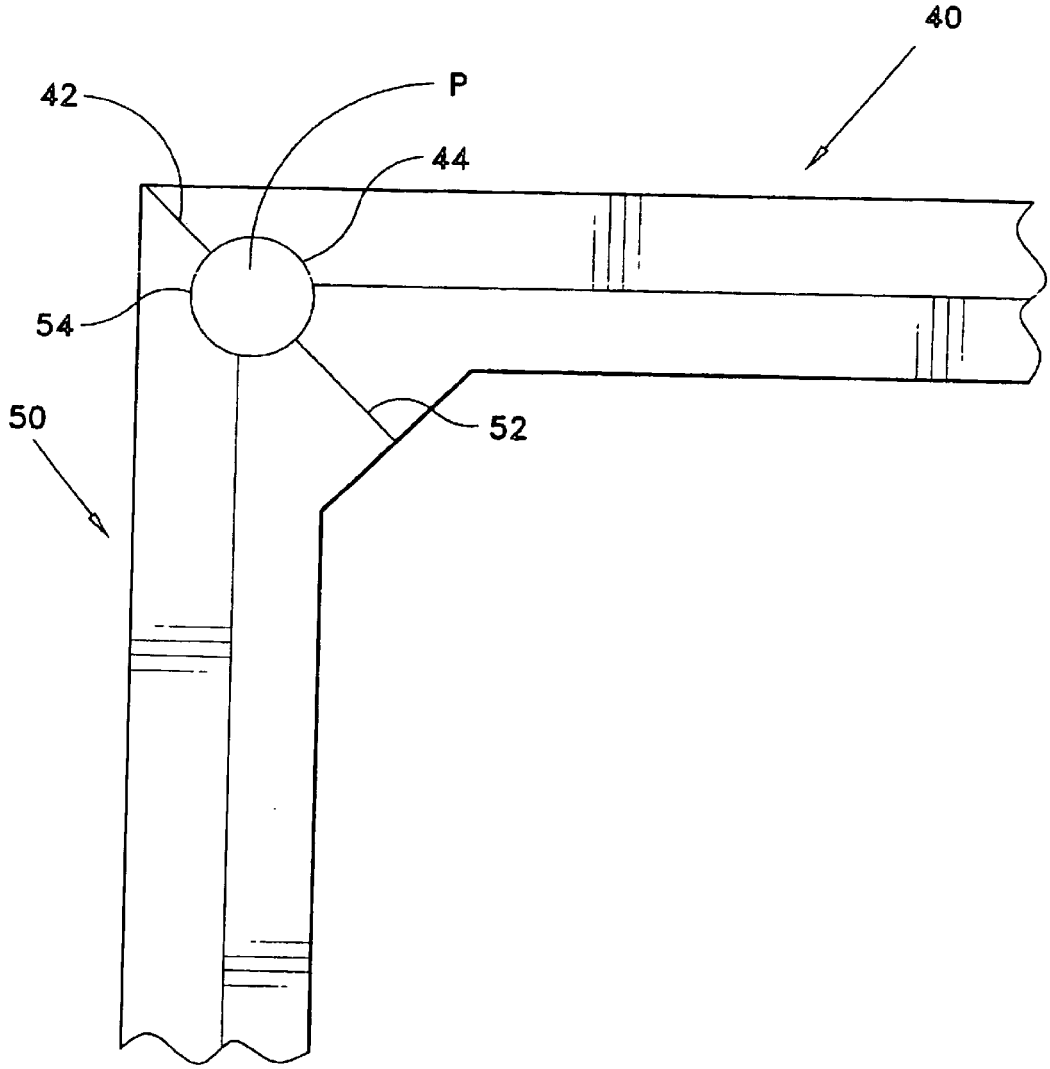
FIG. 3 is a top view of a corner segment of the first embodiment of the weed guard.

The weed guard 10 further comprises a plurality of corner guard links. FIG. 3 depicts two adjacent corner guard links 40, 50 secured to one another around a corner fence post P. When the weed guard 10 reaches a location where there is a corner in the fence F, the weed guard 10 must turn to continue along with the fence line. The corner guard links 40, 50 are adapted to be secured to fence posts P at the corner of the fence F. The corner guard links 40, 50 comprise essentially all of the same elements as the linear guard links 20. The corner guard links 40, 50 alternatively comprise a corner end 42, 52 with corner receiving slots 44, 54. The corner ends 42, 52 are angled to fit the corner guard links 40, 50 around the corner fence post P.

Figure 4:
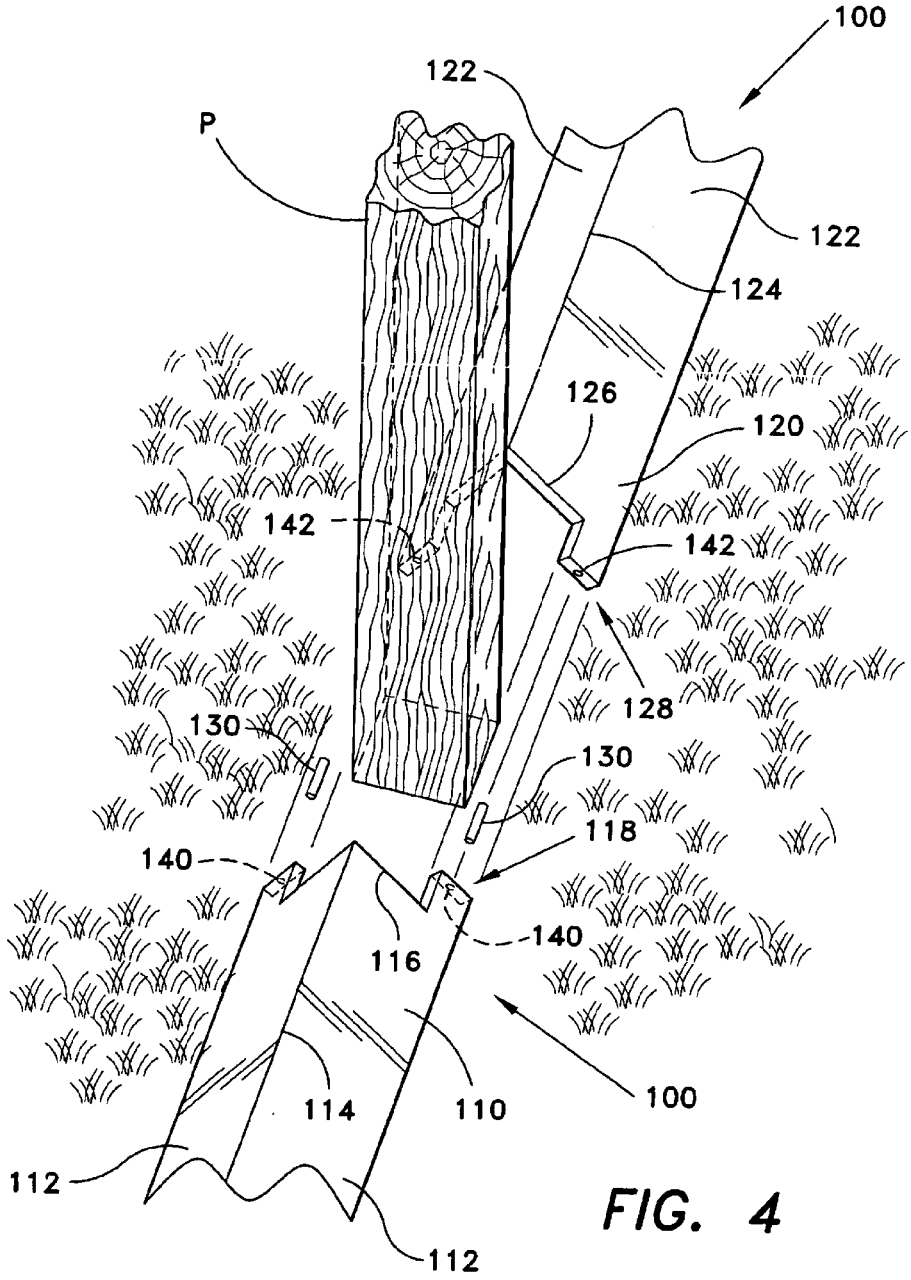
FIG. 4 is an exploded top perspective view of a second embodiment of the weed guard.

FIG. 4 depicts an alternate embodiment of the fence weed guard 100. The weed guard 100 in the present embodiment is adapted to secure to a fence F with generally square shaped fence posts P. The weed guard 100 comprises a plurality of linear guard links 110, which are secured to adjacent guard links 120 around a fence post P. The guard links 110, 120 comprises essentially the same elements as discussed in accordance with the previous embodiment including ends 118, 128, upwardly converging side portions 112, 122, peaked top portions 114, 124, and post receiving slots 116, 126 disposed on the ends 118, 128. The only difference is that the post receiving slots 118, 128 are generally square shaped to fit around generally square shaped fence posts P.

The guard links 110, 120 further comprise a plurality of connector holes 140, 142. The connector holes 140, 142 are disposed on the ends 118, 128 of the adjacent guard links 110, 120. The connector holes 140, 142 are adapted to receive the fasteners 130. The fasteners 130 are preferably dowels, but any suitable fastener may be used. The fasteners 130 secure the adjacent guard links in the same manner as discussed for the previous embodiment of the weed guard 10.

The weed guards 10, 100 protect the fence F from natural elements such as weeds, grass, shrubbery and trees. If these natural elements remain in contact with the fence F for a long period of time they will cause damage to the fence F. The weed guards 10, 100 are made from a flexible material including, but not limited to, rubber and soft plastic. The base 12 of the weed guards 10, 100 is positioned underneath the fence F and follows along the entire fence line. The weed guards 10, 100 are preferably 6 inches wide, extending 3 inches out from both sides of the fence F, but may be made any size depending on the type of fence and amount of weeds that need to be covered. The weed guards 10, 100 may be secured to any type of fence including, but not limited to, wood, wire, vinyl and iron fences.

Figure 5:
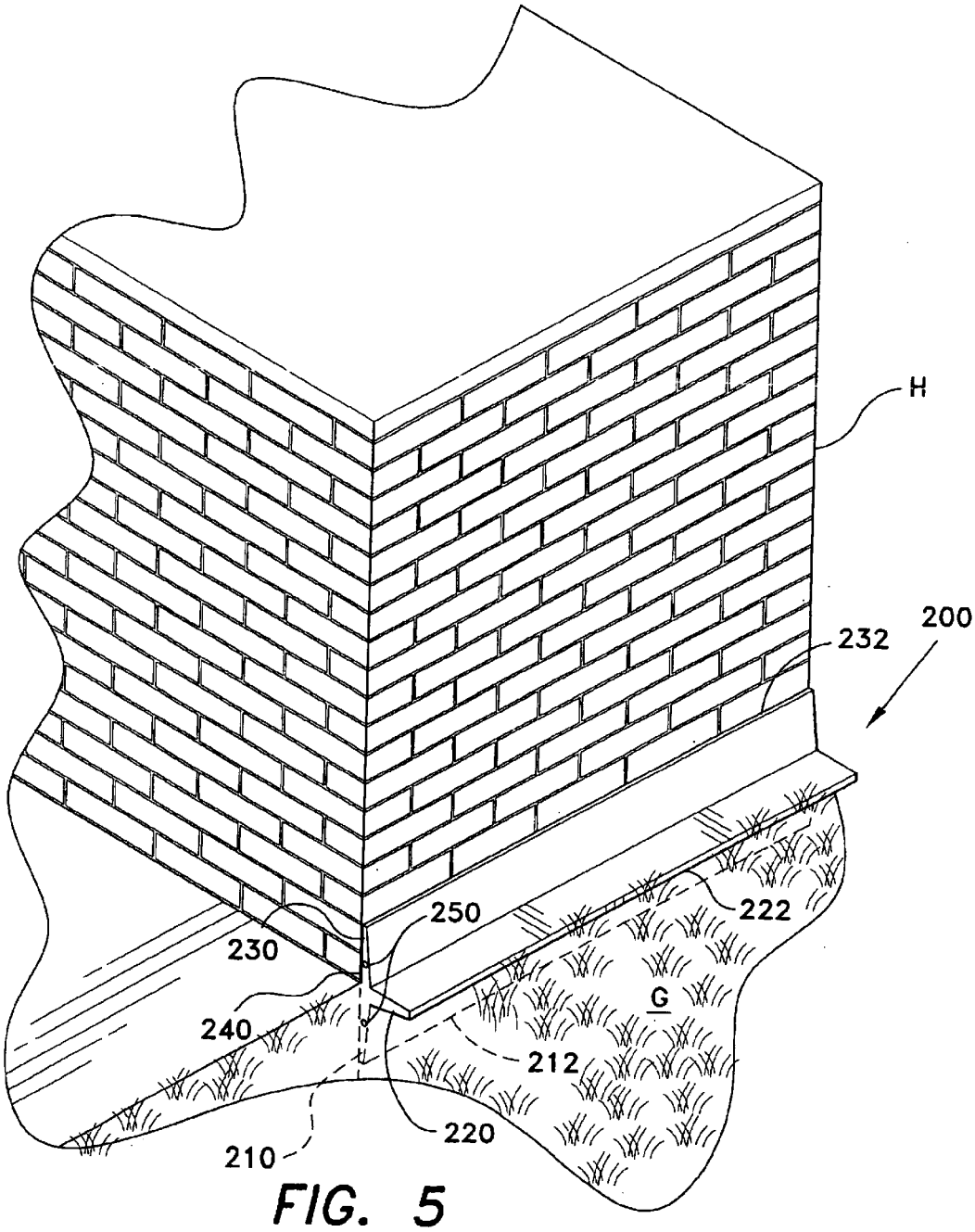
FIG. 5 is an environmental perspective view of a third embodiment of the weed guard.

An additional embodiment of the present invention is a weed guard 200 that may be secured to any building structure. The weed guard 200 according to the present embodiment may be secured to vertically oriented structures, such as houses and walls. FIG. 5 depicts the weed guard 200 secured to the side of a house H. The weed guard 200 comprises a flexible, elongate body with a plurality of planar projection portions and a main body portion 240. The weed guard 200 preferably has a base projection portion 220, a ground mounting projection portion 210 and a back projection portion 230. The planar projection portions extend outwardly from the center of the main body portion 240 forming a generally triangular shaped, three prong weed guard 200.

The bottom edge 212 of the ground mounting projection portion 210 extends into the ground to secure the weed guard 200 in its desired location. The bottom surface 222 of the base projection portion 220 is positioned on top of the weeds and grass G to prevent them from contacting and damaging the house H. The rear surface 232 of the back projection portion 230 is securely mounted to the surface of the house H. A plurality of connector holes 250 are disposed on each end of the weed guard 200. A rubber adhesive is optionally applied to the rear surface 232 to provide a more secure fit against the house H.

Figure 6:
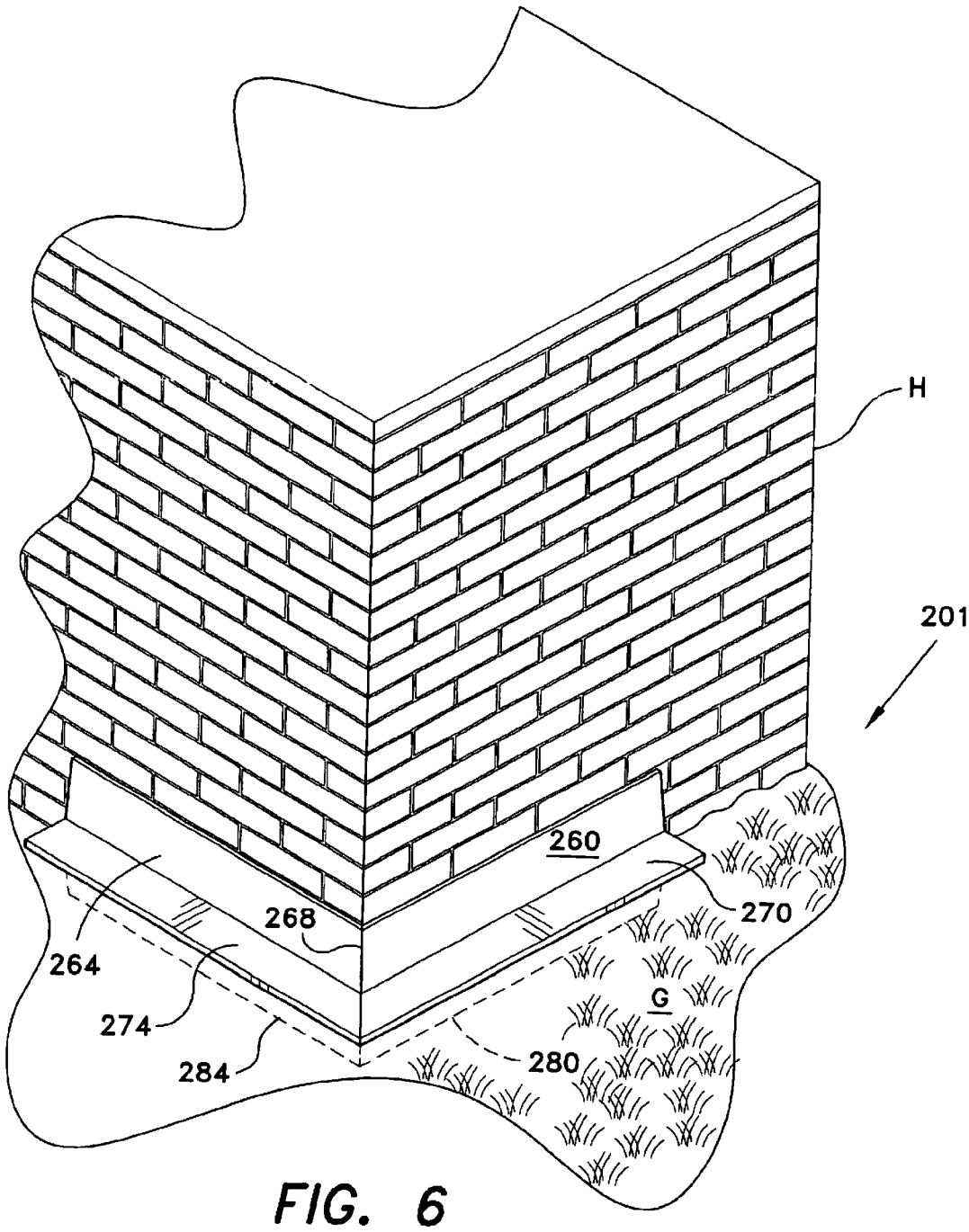
FIG. 6 is an environmental, perspective view a corner segment of the weed guard according to the third embodiment.

FIG. 6 depicts a perspective view of a corner guard link 201. The corner guard link 201 is adapted to fit around the corner of the building structure H that the weed guard 200 is attached to. The corner guard link 201 comprises a right back projection 260 and a left back projection 264. The right and left back projections 260, 264 for a center seam 262 along the corner of the house H. The corner guard link 201 also comprises a right base projection 270 and a left base projection 274 disposed on top of the grass and weeds G. The corner link 201 further comprises a right mounting projection 280 and a left mounting projection 284. The ground mounting projections secure the corner link 201 into the ground.

Figure 7:
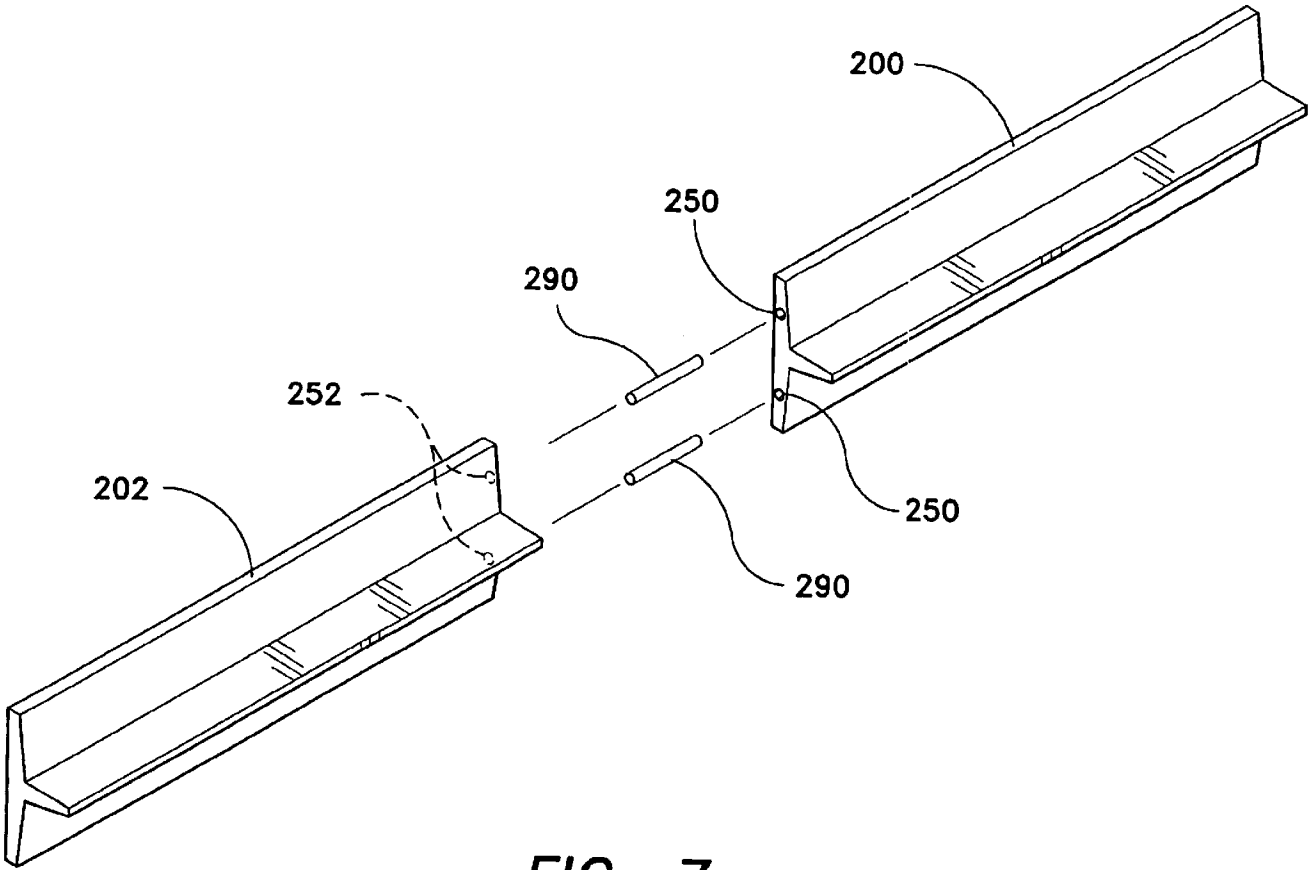
FIG. 7 is a perspective view of two adjoining linear segments of the weed guard according to the third embodiment.

FIG. 7 is an exploded perspective view of adjacent weed guards 200, 202. Each of the weed guards 200, 202 have a plurality of connector holes 250, 252 disposed on the ends of each weed guard 250, 252. The connector holes 250, 252 allow a plurality of weed guards 200 to be connected to extend the weed guard 200 along the entire length of the house H. The adjacent weed guards 200, 202 are secured to one another by a plurality of fasteners 290 that engage each weed guard 200, 202 through the connector holes 250, 252. The fasteners are preferably dowels. A layer of rubber adhesive may optionally be applied to the ends of the weed guards 200, 202 to enhance the connection.

Figure 8:
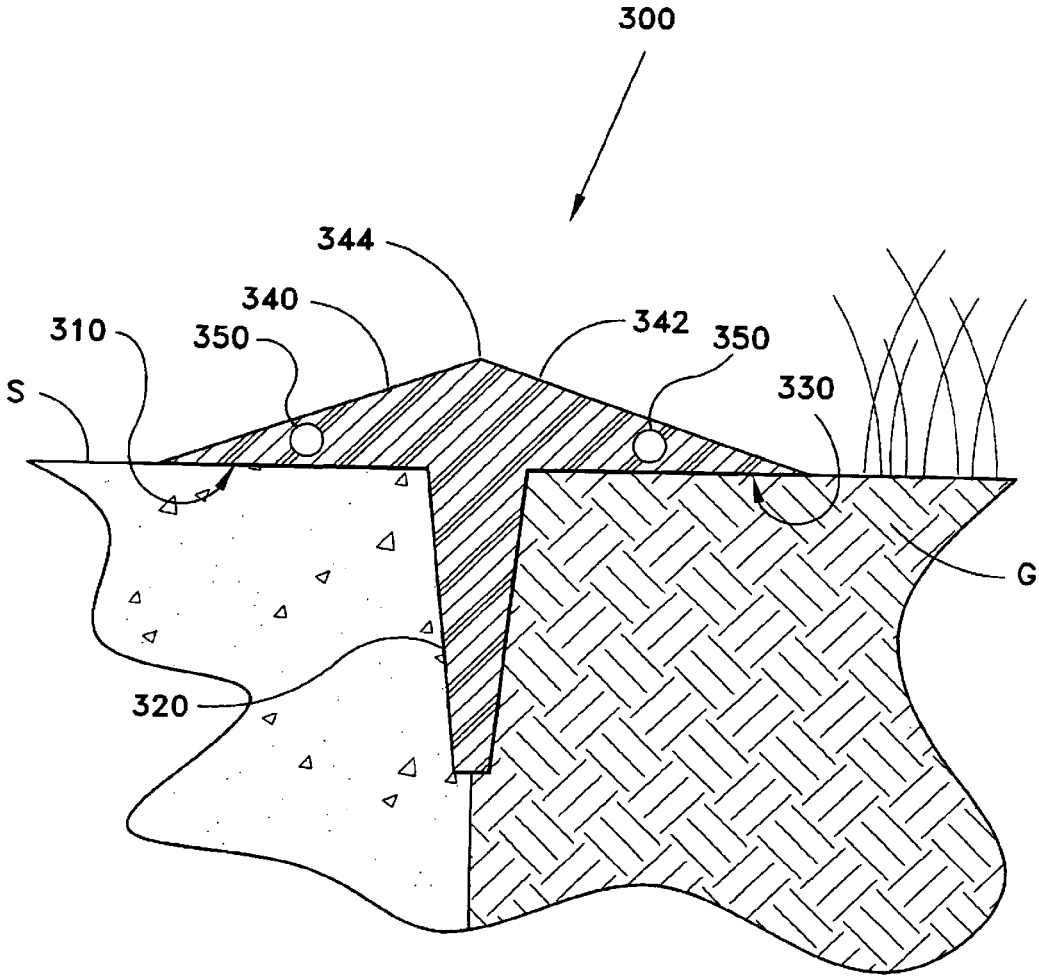
FIG. 8 is a side view of a fourth embodiment of the weed guard.

The present embodiment of the weed guard 200 is also made from a flexible material including, but not limited to, rubber and soft plastic. The flexible material allows the weed guard 200 to be applied to any structural surface. FIG. 8 depicts an alternate embodiment 300 of the structural weed guard 200 being used to protect a horizontally oriented building structure. The horizontally disposed building structure depicted in FIG. 8 is a sidewalk S but the weed guard 300 may be attached to any horizontally disposed building structure including, but not limited to, driveways and patios. The weed guard 300 is positioned between the sidewalk S and the weeds and grass G to prevent the weeds and grass G from growing over and damaging the sidewalk S.

The weed guard 300 is similar to the weed guard 200 in FIG. 6. The weed guard 300 has a ground mounting projection portion 320 extends into the ground between the grass G and the sidewalk S. A front portion 310 is positioned over the sidewalk S and a back projection portion 330 is placed on top of the grass G. The present, alternate embodiment of the weed guard 300 further comprises a pair of inclined converging top projections 340, 342 that intersect to form a peaked top portion 344. The projections 340, 342 are inclined to allow water to flow off of the weed guard 300. The weed guard 300 also includes a plurality of connector holes 350 for securing the weed guard 300 to adjacent weed guards. The weed guard 300 is secured to adjacent weed guards in the same manner as discussed with the previous embodiments.

The weed guard provides a device that will keep a fence or building structure clean from unwanted weeds. The weed guard will also protect a fence or building structure from damage caused by overgrown weeds. There is no maintenance necessary for the weed guard and it may be left in place for up to fifteen years. The weed guard is also easily removable so it may be transferred to a different location and reused. The weed guards 200 for use with the vertically disposed building structures may also be used as a planter. Flowers and other plants may be placed on top of the ground mounting projection portion 220 to enhance the aesthetic appeal of the building line.

It is to be understood that the present invention is not limited to the embodiments described above, but encompasses any and all embodiments within the scope of the following claims.

I claim:

1. A weed guard comprising:

a plurality of linear guard links, each having a pair of ends, a bottom surface and upwardly convergent side portions forming a peaked top portion;

a post securing slot disposed on each of said pair of ends adapted for securing a first of said linear guard links to an adjacent linear guard link around a fence post, wherein said post securing slot of said first of said linear guard links and said adjacent linear guard link securely fit around the fence post and engage one another;

a plurality of connector holes disposed on each of said pair of ends; and a plurality of dowels inserted into said connector holes and joining said plurality of guard links together end-to-end without overlapping;

whereby said linear guard links are secured underneath a fence to a bottom portion of the fence post to prevent weeds from growing along and damaging the fence.

2. The weed guard according to claim 1, wherein said post securing slot comprises a shape and dimensions equal to one half of the circumference of said fence post so that each of said post securing slots fits around exactly one half of said fence post.

3. The weed guard according to claim 1, wherein said upwardly convergent side portions are inclined so that said peaked top portion fits in direct contact with the bottom of the fence.

4. The weed guard according to claim 1, wherein said post securing slot is selected from the group consisting of square slots and circular slots.

5. The weed guard according to claim 1, further comprising a plurality of corner guard links wherein said corner guard links each comprise at least one angled end adapted to secure said corner guard link to a corner fence post.

6. The weed guard according to claim 5, further comprising an angled post receiving slot disposed on said angled end.

7. The weed guard according to claim 1, wherein said weed guard is made from a flexible material.

8. The weed guard according to claim 7, wherein said flexible material is selected from the group consisting of rubber and soft plastic.

9. The weed guard according to claim 1, further comprising an adhesive on each of said pair of ends to further secure said linear guard links to one another.

10. The weed guard according to claim 1, further comprising a ground mounting member disposed underneath the bottom surface of each said linear guard link, said ground mounting member having an elongate body and a generally triangular cross section.

* * * * *